US007731557B2

(12) United States Patent
Nelson et al.

(10) Patent No.: US 7,731,557 B2
(45) Date of Patent: Jun. 8, 2010

(54) TOY AIRPLANE WITH FINGER ROLLER LAUNCHING SYSTEM

(76) Inventors: Webb T. Nelson, 19180 144th Ave., NE., Woodinville, WA (US) 98072; Mark J. Chernick, 19180 144th Ave., NE., Woodinville, WA (US) 98072; Simeon Tiefel, 11355 SW. 97th Ct., Tigard, OR (US) 97223

( * ) Notice: Subject to any disclaimer, the term of this patent is extended or adjusted under 35 U.S.C. 154(b) by 380 days.

(21) Appl. No.: 11/357,377

(22) Filed: Feb. 18, 2006

(65) Prior Publication Data

US 2007/0197121 A1 Aug. 23, 2007

(51) Int. Cl.
*A63H 27/00* (2006.01)

(52) U.S. Cl. ..... 446/61; 446/45; 446/36; 446/68

(58) Field of Classification Search ..... 446/61, 446/45, 36, 68
See application file for complete search history.

(56) References Cited

U.S. PATENT DOCUMENTS 2,311,160 A * 2/1943 Dobbelaar ..... 124/5
4,452,007 A * 6/1984 Martin ..... 446/45
4,596,368 A * 6/1986 Schmittle ..... 244/48
4,863,412 A 9/1989 Mihalinec ..... 446/66
5,046,979 A * 9/1991 Ragan et al. ..... 446/57
6,139,392 A 10/2000 Walker et al. ..... 446/61
2005/0233672 A1* 10/2005 Shantz ..... 446/232

* cited by examiner

*Primary Examiner*—Gene Kim
*Assistant Examiner*—Michael D Dennis
(74) *Attorney, Agent, or Firm*—LaMorte & Associates

(57) ABSTRACT

A toy airplane with a specialized launching configuration. The toy airplane has a body that extends between a nose and a tail. A roller assembly is disposed at the nose of the toy airplane. The roller assembly includes a free rotating finger roll that protrudes to the left and to the right of the nose. When a person launches the toy airplane, that person places his/her fingers behind the finger rolls on either side of the nose. As a person makes a throwing motion, the fingers roll off of the finger rolls just as the toy airplane is reaching its maximum velocity. The presence of the finger rolls, therefore, prevents a person from holding onto the toy airplane too long as it is being thrown.

9 Claims, 6 Drawing Sheets

TOY AIRPLANE WITH FINGER ROLLER LAUNCHING SYSTEM

BACKGROUND OF THE INVENTION

1. Field of the Invention

In general, the present invention relates to toy airplanes and other such manually launched projectiles. More particularly, the present invention relates to the interface on the toy airplane where a person engages the airplane in order to throw the airplane.

2. Prior Art Description

There are many different types of toy airplanes that are designed to actually fly. Many of these toy airplanes have strong motors and landing gear that enable the toy airplanes to take flight without being launched. Such toy airplanes tend to be expensive and remote controlled. Such toy airplanes are therefore designed primarily for use by skilled adults. However, the majority of flying toy airplanes are designed for children and come in the form of gliders. Such toy airplanes must be manually thrown and can sustain flight for only short periods of time.

The simplest of toy airplanes, such as folded paper airplanes, are simply grasped by a user's fingers and thrown forward. The action of throwing an airplane requires significant coordination. If a toy airplane is not thrown straight, it will not fly straight. If a toy airplane is held too long during a throw, the airplane is directed into the ground when released. If a toy airplane is thrown too hard or too softly, the airplane will stall in flight. Therefore, throwing a toy airplane correctly is difficult for many people, especially young children.

If a toy airplane is not thrown correctly, the airplane tends not to fly straight and crash lands. It is the crashing of the toy airplane into the ground that usually causes damage to the airplane and the eventual destruction of the toy airplane. A child may therefore crash and break an airplane well before that child has the chance to learn how to throw the airplane correctly.

In the prior art, there have been many toy airplanes that have been designed to help a child throw the airplane correctly. For example, many toy airplanes are designed with hooks that can be engaged with a rubber band. The airplane can then be launched by engaging the hook with a rubber band and stretching the rubber band. Such prior art launching systems are exemplified by U.S. Pat. No. 4,863,412, to Mihalinee, entitled Glider Toy Assembly.

In U.S. Pat. No. 6,139,392, to Walker, entitled Glider Toy, shows a toy airplane that is manually thrown. The toy airplane has holes formed in its fuselage that help a child to properly grip, throw and release the airplane. However, such launching systems require that the toy airplane have a long wide fuselage to accommodate the finger holes. Toy airplanes rarely have such fuselages, thus the use of the launching system is limited.

Although the use of rubber bands and finger holes may help in the launching of toy airplanes, such structures do nothing to help the toy airplanes safely land. The present invention sets forth a launching system that enables a person to correctly launch a toy airplane with little or no practice. The present invention launching system also has the added advantage of helping a toy airplane land safely without damage. The present invention system is described and claimed below.

SUMMARY OF THE INVENTION

The present invention is a toy airplane with a specialized launching configuration. The toy airplane has a body that extends between a nose and a tail. A roller assembly is disposed at the nose of the toy airplane. The roller assembly includes a free rotating finger roll that protrudes to the left and to the right of the nose. When a person launches the toy airplane, that person places his/her fingers behind the finger rolls on either side of the nose. As a person makes a throwing motion, the fingers roll off of the finger rolls just as the toy airplane is reaching its-maximum velocity. The presence of the finger rolls, therefore, prevents a person from holding onto the toy airplane too long as it is being thrown.

Since the rolling assembly is located at the nose of the toy airplane, the roller assembly is the forward most part of the toy airplane. The roller assembly therefore is the first part of the toy airplane to strike the ground when the toy airplane crashes or lands. The roller assembly is made of shock absorbing materials that absorb energy at impact, thereby helping prevent impact damage to the toy airplane.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention toy airplane can have a fuselage made from any common toy airplane materials, such as Styrofoam, plastic, balsa wood and the like, the present invention toy airplane is especially well suited for a fuselage with a kite-like construction. That is, the fuselage is made of fabric stretched between support rods. Accordingly, in the initial description of the present invention, the exemplary toy airplane will have a kite-like construction in order to set forth the best mode contemplated for the invention.

Figure 1:
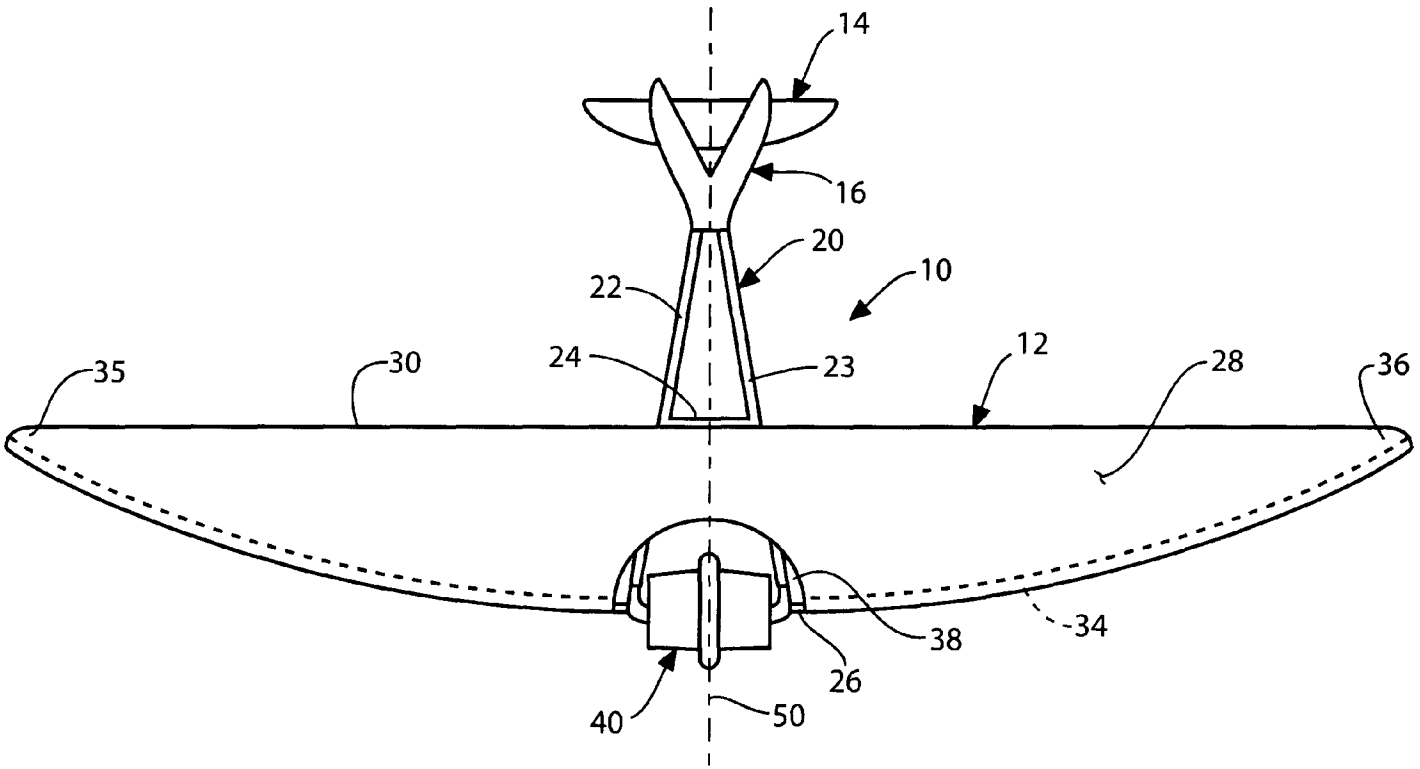
FIG. 1 shows a front, perspective view of an exemplary embodiment of the present invention.

Referring to FIG. 1, there is shown a toy airplane 10. The toy airplane 10 has a primary wing 12, a tail wing 14 and a stabilizer wing 16. The primary wing 12, tail wing 14 and stabilizer wing 16 are all joined together by a body frame 20. The body frame 20 is comprised of two angled rods 22, 23 that converge near the tail wing 14. A crossbar 24 is provided to stabilize the angled rods 22, 23.

In the shown embodiment, the primary wing 12, tail wing 14, and stabilizer wing 16 all have a kite-like construction. This means that the various wings are all constructed of segments of material that are stretched between a framework of rods. More specifically, the primary wing 12 includes a long, flexible front rod 26. The wing front rod 26 is joined to the angled rods 22, 23 of the body frame 20. A crescent-shaped piece of fabric 28 is provided. The forward edge 32 of the fabric 28 has a tubular seam 34. The wing front rod 26 passes through the tubular seam 34, thereby joining the fabric 28 to the wing front rod 26.

The opposite ends of the wing front rod 26 engage the salient corners 35, 36 of the crescent-shaped piece of fabric 28. The wing front rod 26 must be bent for the ends of the wing front rod 26 to engage the salient corners 35, 36 of the fabric 28. Consequently, the spring tension created by the bending of the wing front rod 26 acts to hold the crescent-shaped piece of fabric 28 open and taut.

The rear edge 30 of the crescent shaped piece of fabric 28 attaches to the crossbar 24 of the body frame 20. This interconnection prevents the crescent-shaped piece of fabric 28 from lifting away from the body frame 20.

A recess 38 is formed in the crescent-shaped piece of fabric 28 at the center of its forward edge 32. The recess 38 is provided to allow room for a roller assembly 40 and to allow a user's fingers to engage the roller assembly 40.

The toy airplane 10 has a central symmetry line 50 that passes down the center of the toy airplane 10 from its tail to its nose. The toy airplane 10 is symmetrically disposed on either side of the central symmetry line 50. Accordingly, the toy airplane 10 has a left side and a right side that are mirror images of each other.

The roller assembly 40 is bisected by the central symmetry line 50. Accordingly, half of the roller assembly 40 extends outwardly from the left side of the toy airplane, and half extends out on the right.

Figure 2:
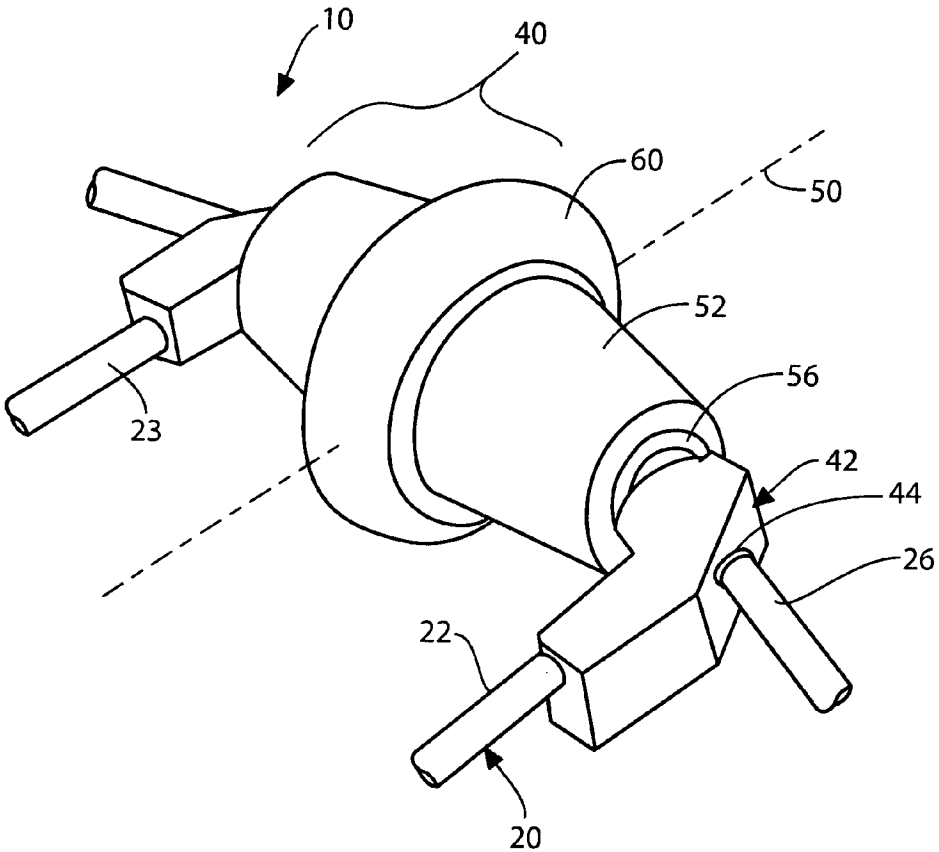
FIG. 2 is an enlarged perspective view of the roller assembly embodiment of the toy airplane shown in FIG. 1.
Figure 3:
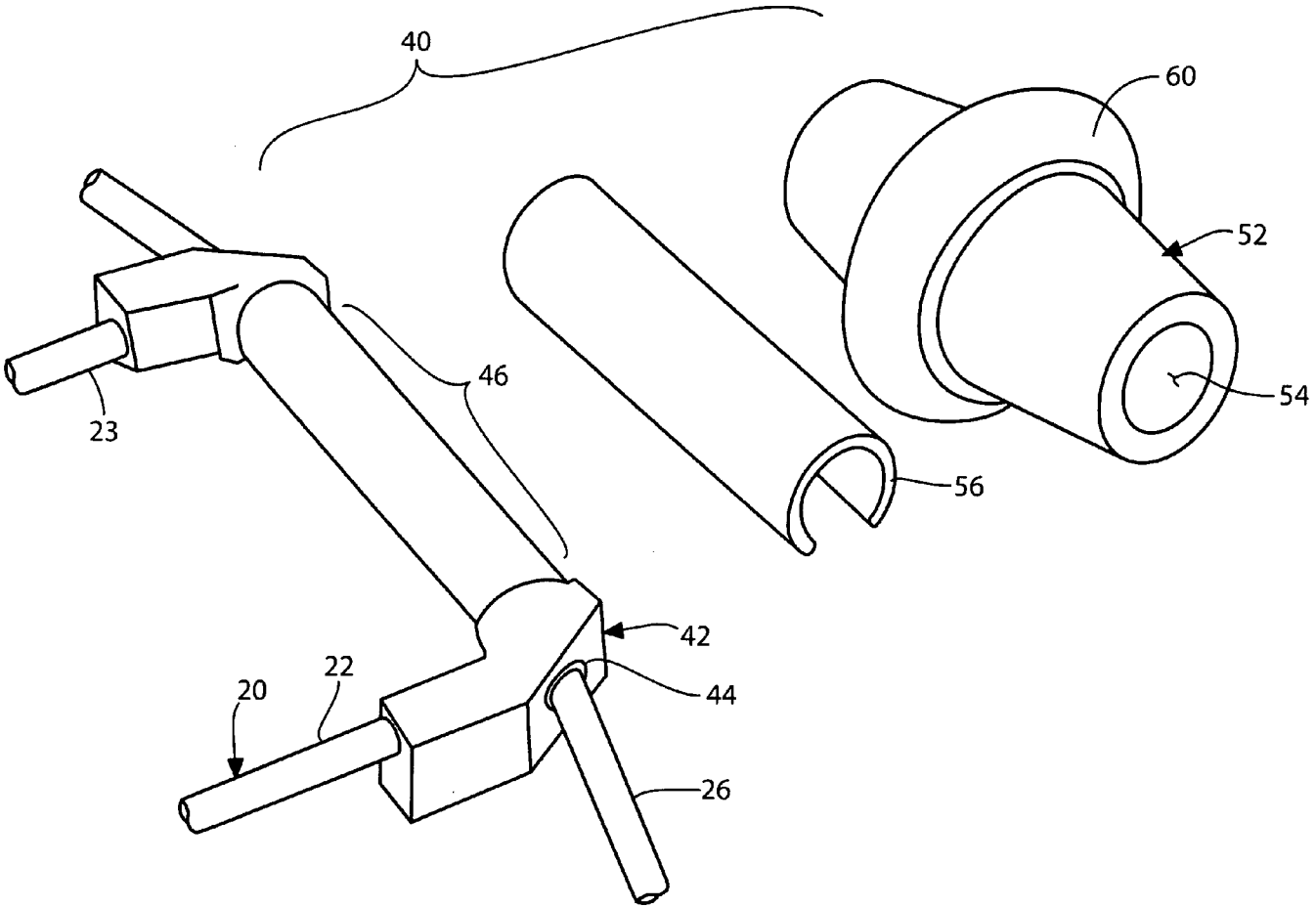
FIG. 3 is an exploded view of the embodiment of FIG. 2.

Referring to FIG. 2 and FIG. 3, it can be seen that the roller assembly 40 has three major components. At the center of the roller assembly 40 is a connection bracket 42. The connection bracket 42 engages the two angled rods 22, 23 of the body frame 20. The connection bracket 42 also defines an open conduit 44 through which the wing front rod 26 of the toy airplane 10 passes. A segment 46 of the connection bracket 42 has a cylindrical exterior shape. This cylindrical segment 46 acts as an axle for the remainder of the roller assembly 40.

The roller assembly 40 is the forward most part of the toy airplane 10. The roller assembly 40 includes a wide finger roll 52. The finger roll 52 can be cylindrical in shape. The ends of the finger roll 52 taper inwardly, thereby providing each end of the finger roll 52 with a frustum shape. The central symmetry line 50 of the toy airplane 10 bisects the finger roll 52. Consequently, half of the finger roll 52 extends out on the right side of the toy airplane 10 and half extends out on the left side of the toy airplane 10. The finger roll 52 preferably extends out from both the right and left sides of the toy airplane 10 by a least ½ inch so that the finger roll 52 can be engaged by a user's fingers on both sides of the toy airplane 10.

A central conduit 54 passes through the finger roll 52. A cylindrical bearing 56 passes into the central conduit 54. The cylindrical bearing 56 fits around the cylindrical segment 46 of the connection bracket 42. The cylindrical bearing 56 rotates freely around the cylindrical segment 46 of the connection bracket 42. The cylindrical bearing 56 passes into the central conduit 54 of the finger roll 52. As a result, the cylindrical bearing 56 enables the finger roll 52 to rotate freely around the cylindrical segment 46 of the connection bracket 42.

The roller assembly 40 also includes a large central wheel 60. The wheel 60 is placed around the center of the finger roll 52. The wheel 60 is in line with the central symmetry line 50 of the toy airplane 10. The wheel 60 is made of a highly resilient material. The wheel 60 has a diameter that is significantly larger than the maximum diameter of the finger roll 52. As a consequence, the periphery of the wheel 60 represents both the forward most part of the toy airplane 10 and the lowest most part of the toy airplane 10.

Figure 4:
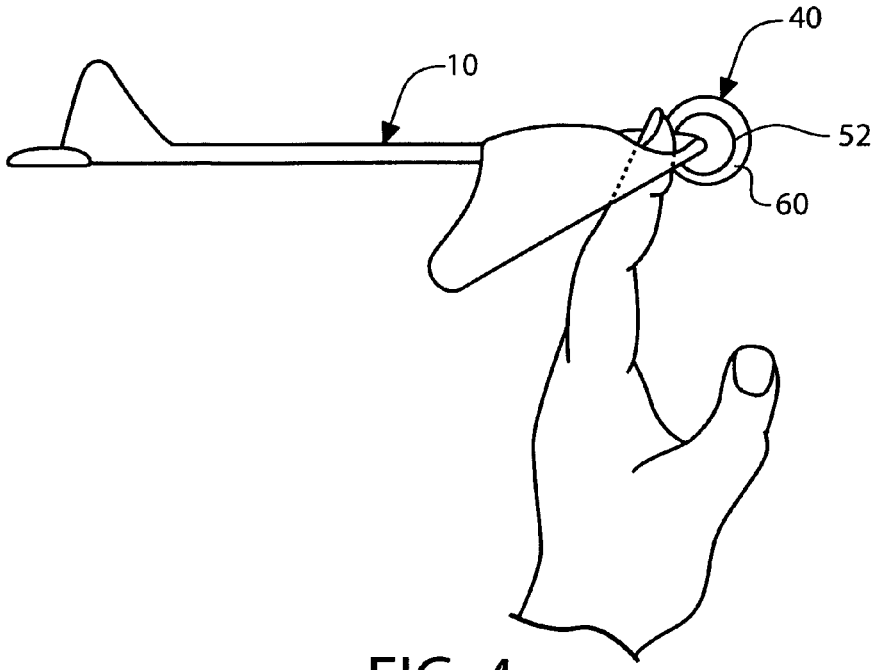
FIG. 4 is a side view of the toy airplane embodiment of FIG. 1 shown being grasped and thrown.
Figure 5:
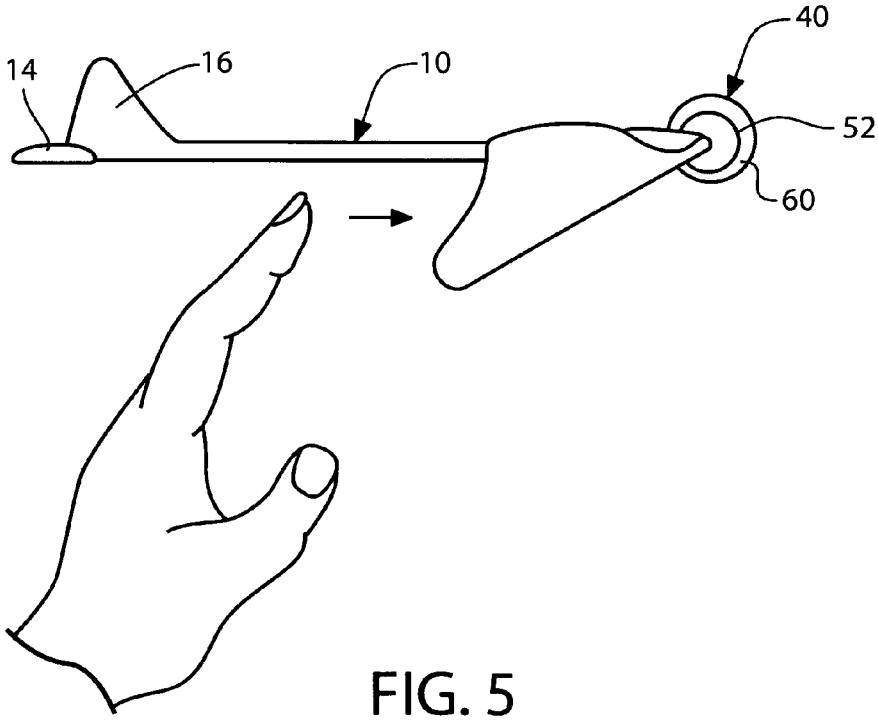
FIG. 5 shows the view of FIG. 4 after the toy airplane has been thrown.

Referring to FIG. 4 and FIG. 5, it can be seen that the roller assembly 40 is used during the launching of the toy airplane 10. To launch the toy airplane 10, a user places his/her fingers against the finger roll 52, on either side of the center wheel 60. With the fingers in contact with the finger roll 52, a user makes a forward throwing action. As the user's fingers move with the hand through a throwing action, the fingers cause the finger roll 52 to rotate. Due to the rotation of the finger roll 52, a user's fingers tend to roll off of the finger roll 52 and separate from the toy airplane 10 at the point of optimal forward velocity. Thus, even an unskilled person can correctly throw the toy airplane 10 without worrying about where to grasp the toy airplane 10 and when to release the toy airplane 10.

Figure 6:
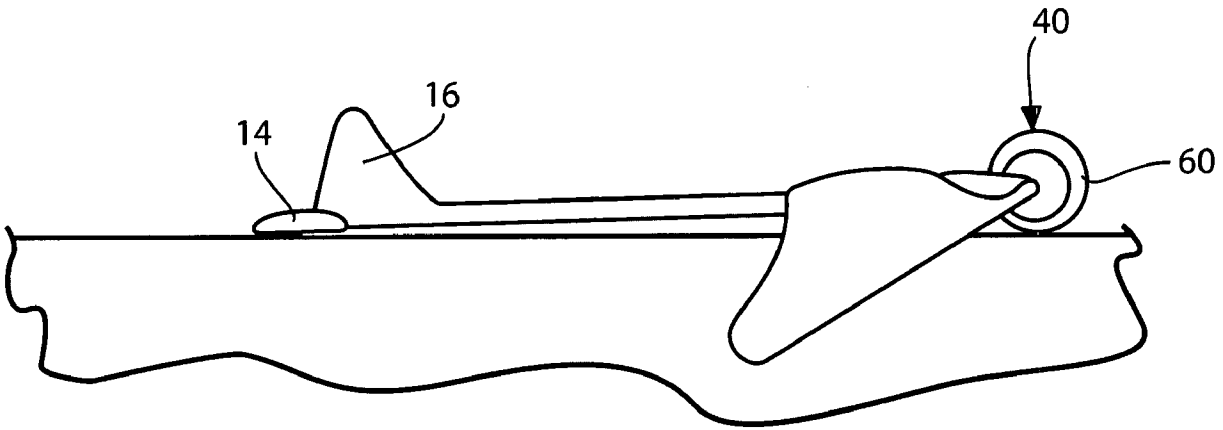
FIG. 6 shows the toy airplane embodiment of FIG. 1 landing on a hard surface.

Referring to FIG. 6, it can be seen that when the toy airplane 10 glides to a landing, the roller assembly 40 again comes into use. As the toy airplane 10 approaches the ground, the center wheel 60 of the roller assembly 40 is the first part of the toy airplane 10 to make contact. The center wheel 60 touches the ground first regardless of the angle of approach for the airplane 10. The center wheel 60 is highly resilient. Consequently, if the toy airplane 10 approaches the ground at a sharp crash angle, the center wheel 60 absorbs much of the energy of impact. If the toy airplane 10 approaches the ground at a low angle, the center wheel 60 will contact the ground and roll. The toy airplane 10 will therefore roll to a gentle stop and will not be damaged.

It will be understood that the roller assembly 40 has significant weight in relation to other parts of the toy airplane 10. By positioning the roller assembly 40 at the nose of the toy airplane 10, the roller assembly 40 counterbalances the weight of the tail wing 14 and stabilizer wing 16. The center of gravity for the overall toy airplane 10 remains centralized, thereby allowing the toy airplane 10 to have good aerodynamic flight characteristics.

In the embodiment shown in FIG. 1 through FIG. 5, the toy airplane 10 has a kite-like construction. However, it will be understood that the roller assembly 40 can be applied to other types of toy airplanes 10. The advantages embodied by the roller assembly 40 can therefore be applied to prior art toy airplane designs.

Figure 7:
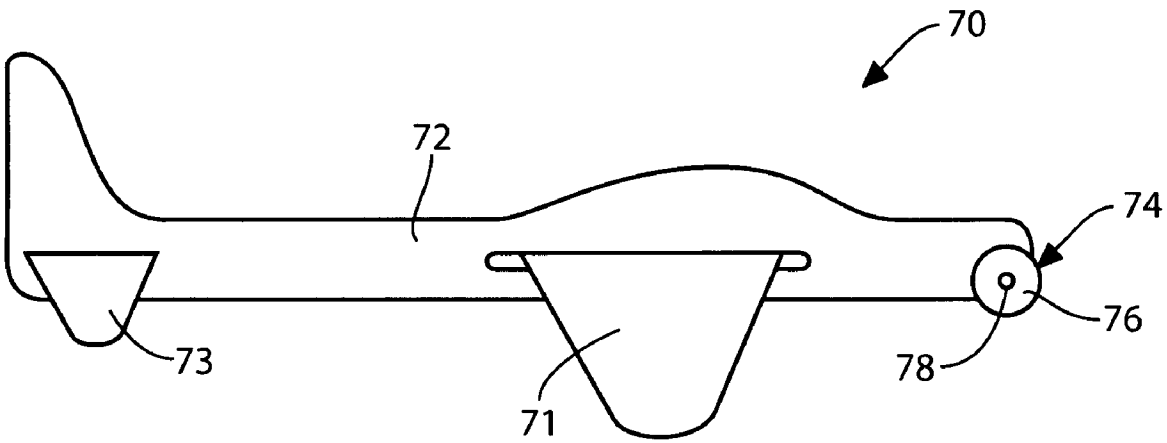
FIG. 7 shows an alternate embodiment of the present invention.

Referring to FIG. 7, there is shown a toy airplane 70. The toy airplane 70 has a thin central fuselage 72 made from balsa wood or plastic. A primary wing 71 and a tail wing 73 are set in slots that extend through the thin central fuselage 72. Such toy airplane construction is well known and used in the art.

What makes the toy airplane 70 design unique is the application of a roller assembly 74 to the nose of the toy airplane 70. In the simplified embodiment of FIG. 7, the roller assembly 74 consists of two finger rolls 76 that are positioned on opposite sides of the thin central fuselage 72 near the nose. An axle pin 78 is set through the thin central fuselage 72. The two finger rolls 76 are set on the axle pin 78 and are free to rotate around the axle pin 78. Consequently, when the finger rolls 76 are contacted during launching, a user's fingers will roll off the finger rolls 76 in the same manner described previously with reference to FIG. 3 and FIG. 4.

The finger rolls 76 are at the bottom of the nose of the toy airplane 70. Consequently, the finger rolls 76 themselves act as an impact buffer in a crash landing or act as landing gear in a smooth landing. Either way, the finger rolls 76 absorb energy during a landing and help prevent damage to the toy airplane 70.

It will be understood that the embodiments of the present invention that have been described and illustrated are merely exemplary and that a person skilled in the art can make many changes to the embodiments using functionally equivalent components. The toy airplane shown in FIG. 1 is believed to be a novel design. However, the concept of a roller assembly, as described, can be applied to numerous prior art toy airplane designs. All such variations, modifications and alternate embodiments are intended to be included within the scope of the present invention as defined by the claims.

What is claimed is:

1. A toy airplane device that is launched by being manually thrown, said airplane device comprising:

a fuselage having a nose end and a tail end that are linearly aligned, wherein said fuselage is disposed about an imaginary central symmetry line; and a single finger roll coupled to said fuselage proximate said nose end, said finger roll being free-spinning and having a central surface that contacts the ground when said toy airplane device lands, wherein said finger roll and said central surface are bisected by said central symmetry line and wherein said central surface of said finger roll is linearly aligned with said nose end and said tail end of said fuselage.

2. The device according to claim 1, wherein said finger roll includes a wheel disposed around a free-spinning roll, wherein said wheel has a diameter larger than said free-spinning roll, wherein said wheel serves as said central surface of said finger roll.

3. The device according to claim 2, wherein said wheel rotates with said free-spinning roll.

4. The device according to claim 3, wherein said free-spinning roll is tapered on either side of said wheel.

5. The device according to claim 1, wherein said finger roll is the forward most part of said toy airplane.

6. A toy airplane device that is launched by being manually thrown, said airplane device, comprising: a frame supporting a primary wing and a tail, wherein said primary wing has a forward edge; and a roller disposed in the center of said forward edge of said primary wing, wherein said roller is free-spinning; and wherein a relief is disposed in said primary wing behind said roller to enable a person to physically engage said roller from behind when launching said toy airplane; further including a wheel, wherein said roller passes through said wheel and said wheel is disposed in the center of said roller and rotates with said roller.

7. The device according to claim 6, wherein said roller is tapered on either side of said wheel.

8. The device according to claim 6, wherein said roller is the forward most part of said toy airplane.

9. The device according to claim 8, wherein said roller is the lowest most part of said toy airplane.

* * * * *